US009351553B2

(12) United States Patent
Fair et al.

(10) Patent No.: US 9,351,553 B2
(45) Date of Patent: May 31, 2016

(54) DUAL FUNCTION BAG

(71) Applicant: Apera, LLC, Centennial, CO (US)

(72) Inventors: Paul Fair, Denver, CO (US); Andrew Youngs, Centennial, CO (US)

(73) Assignee: Apera, LLC, Centennial, CO (US)

( * ) Notice: Subject to any disclaimer, the term of this patent is extended or adjusted under 35 U.S.C. 154(b) by 0 days.

(21) Appl. No.: 14/182,593

(22) Filed: Feb. 18, 2014

(65) Prior Publication Data

US 2014/0238560 A1 Aug. 28, 2014

Related U.S. Application Data

(60) Provisional application No. 61/770,115, filed on Feb. 27, 2013.

(51) Int. Cl.

| | |
|---|---|
| ***A45C 3/10*** | (2006.01) |
| ***A45C 13/02*** | (2006.01) |
| *A45C 3/00* | (2006.01) |

(52) U.S. Cl.

CPC ..... *A45C 13/02* (2013.01); *A45C 2003/002* (2013.01); *A45C 2003/007* (2013.01)

(58) Field of Classification Search

CPC ..... A45C 9/00; A45C 3/10; A45C 3/12; A45C 5/11; A45C 13/30

USPC ..... 150/106, 107, 109; 206/315.1; 383/103, 383/117; 190/102; 224/156

See application file for complete search history.

(56) References Cited

U.S. PATENT DOCUMENTS

| | | | | |
|---|---|---|---|---|
| 504,850 | A * | 9/1893 | Ponickau | 190/102 |
| 4,154,323 | A * | 5/1979 | Sneider | 190/2 |
| 4,738,545 | A * | 4/1988 | Westgor | 383/4 |
| 5,323,897 | A * | 6/1994 | Sperber | 206/287 |
| 5,676,296 | A * | 10/1997 | Masters | 224/653 |
| 6,386,414 | B1 * | 5/2002 | Kilduff | 224/638 |
| 2005/0127056 | A1 * | 6/2005 | Petkov et al. | 219/211 |
| 2006/0289582 | A1 * | 12/2006 | Killilea | 224/577 |
| 2009/0294455 | A1 * | 12/2009 | Pruchnicki | 220/592.2 |
| 2010/0140307 | A1 * | 6/2010 | Almoumen | 224/155 |
| 2010/0224294 | A1 * | 9/2010 | Svenson | 150/103 |
| 2011/0311166 | A1 * | 12/2011 | Pascua | 383/41 |
| 2013/0322786 | A1 * | 12/2013 | Nassanian | 383/25 |

FOREIGN PATENT DOCUMENTS

| | | | |
|---|---|---|---|
| EP | 0208051 | A2 * | 2/1987 |
| FR | 2666493 | A1 * | 3/1992 |

* cited by examiner

*Primary Examiner* — Sue A Weaver
(74) *Attorney, Agent, or Firm* — Polsinelli PC

(57) ABSTRACT

Implementations described and claims herein provide dual function bag that includes features that accommodate work-related materials and recreational materials. The dual function bag includes a housing formed from a front side and a back side connected by a ventilation strip and a base strip. The bag further includes a first and a second attachment that extends from its respective side. The first and second attachments are coupled at a connection point to form a receiving space adjacent to the ventilation strip. The receiving space is adapted to receive one or more articles. A carrying strap is coupled to the connection point, and the connection point is adapted to cinch the one or more articles in the receiving space when tension is applied to the carrying strap.

20 Claims, 11 Drawing Sheets

DUAL FUNCTION BAG

CROSS REFERENCE TO RELATED APPLICATION

The present application claims priority under 35 U.S.C. §119 to U.S. Provisional Patent Application No. 61/770,115, which was filed on Feb. 27, 2013, entitled "DUAL FUNCTION BAG," and is hereby incorporated by reference in its entirety into the present application.

TECHNICAL FIELD

Aspects of the present disclosure involve a dual functioning bag and more particularly involve a bag that accommodates the needs of both work and recreation.

BACKGROUND

Busy lifestyles often force individuals to plan their recreational activities (e.g., yoga class, spin class, outdoor activities, exercise, etc.) during a break from work or to otherwise squeeze such activities into their schedules, often before or after work. To accommodate the needs of both work and recreation, individuals often carry their work materials (e.g., computing devices, paper documents, etc.) in a work bag, such as a briefcase, and their recreational materials (e.g., sports clothing, yoga mat, sneakers, etc.) in a second bag, such as a gym bag. However, it can be inconvenient and challenging to carry two bags. Some individuals address this issue by carrying their work and recreational materials in a single bag, thereby creating additional problems. For example, most bags are designed for a single function, such as carrying work materials or recreational materials. Further, many bags lack the accommodating features specific to either work bags or recreational bags. For example, a recreational bag may lack compartments and protection for different computing devices, documents, or other work materials, and a work bag may lack compartments for wet items, cosmetics, shoes, or other recreational materials.

In addition to lacking accommodating features, many bags are not suitable for use in an office or work environment as well as a gym or recreational environment. Stated differently, many bags are not capable of handing the different environments, either physically or socially. For example, it is undesirable and otherwise inappropriate for a bag that houses gym clothes and a yoga mat to emit foul odors in a work environment. Additionally, a bag should have a socially acceptable appearance for a workplace setting. Conversely, a bag housing work materials that is placed in a gym or recreational environment should be secure to protect any valuable items, computing devices, and proprietary or confidential materials.

Further, many bags, particularly work bags, fail to sufficiently ventilate articles and/or the interior of the bag. As such, many bags often retain moisture or are prone to the growth of microorganisms.

With these thoughts in mind, among others, various aspects of presently disclosed technology were conceived.

SUMMARY

Implementations described and claimed herein address the foregoing problems by providing a dual function bag adapted for use in both a work environment and a recreational environment. In one implementation, the bag comprises a housing formed from a front side and a back side connected by a ventilation strip and a base strip. The housing forms an enclosure. A first attachment extends from and is integral with the front side, and a second attachment extends from and is integral with the back side. The first and second attachments are coupled at a connection point to form a receiving space adjacent to the ventilation strip outside the enclosure. The receiving space is adapted to receive one or more articles. A carrying strap is coupled to the connection point, and the connection point is adapted to cinch the one or more articles in the receiving space when tension is applied to the carrying strap.

In some implementations, the bag includes a third attachment extending from and integral with the front side, and a fourth attachment extending from and integral with the back side. The first attachment is disposed near a first end of the front side, and the third attachment is disposed near a second end of the front side. The second attachment is disposed near a first end of the back side generally opposite the first attachment, and the fourth attachment is disposed near a second end of the back side generally opposite the third attachment. The third and fourth attachments are coupled at a second connection point to form a second receiving space adjacent to the ventilation strip outside the enclosure and generally coplanar with the first receiving space.

In some implementations, the bag comprises a housing comprising a first end, a second end opposite the first end, and a body extending between the first side and the second side to form an enclosure. The bag may further include a carrying strap and an attachment assembly comprising a first Y-shaped attachment and a second Y-shaped attachment, the first Y-shaped attachment comprising a first pair of arms that extend from upper corners of the first side to meet at a first point outside of the enclosure to form a first receiving space between the first Y-shaped attachment and the housing, the second Y-shaped attachment comprising a second pair of arms that extend from upper corners of the second side to meet at a second point outside of the enclosure to form a second receiving space between the second Y-shaped attachment and the housing, the first point and the second point being coupled together with the carrying strap, the first and the Y-shaped attachments adapted to cinch one or more articles in the first and the second receiving spaces when tension is applied to the carrying strap.

In yet another implementation, the bag may comprise a housing forming an enclosure therein, the housing comprising a ventilation strip on a top portion of the housing, a carrying strap, and at least one attachment mechanism that couples the housing to the carrying strap. The at least one attachment mechanism may comprise at least two members that extend from the attachment point to opposing portions of the housing to form a receiving space between the at least two members and the ventilation strip, the receiving space adapted to cinch one or more articles within the receiving space when the carrying strap is tensioned. The opposing portions of the housing may be a first and a second panel with the ventilation strip positioned between the first and the second panel. The at least one attachment mechanism may comprise a first attachment mechanism, and the at least two members may comprise a first arm and a second arm, the first arm comprising a first portion of the first panel that extends to the carrying strap, the second arm comprising a second portion of the second panel that extends to the carrying strap. The at least one attachment mechanism may further comprise a second attachment mechanism on an opposite side of the carrying strap from the first attachment mechanism, the at least two members further comprising a third arm and a fourth arm, the third arm comprising a third portion of the first panel that extends to the carrying strap, the fourth arm comprising a fourth portion of the second panel that extends to the carrying strap. The first portion of the first panel that extends to the carrying strap may connect to the housing at a top portion and a bottom portion of the housing, wherein an upper portion of the first portion of the first panel that connects to the housing at the top portion of the housing connects to the carrying strap at an outer portion of the carrying strap, and a lower portion of the first portion of the first panel that connects to the housing at a bottom portion of the housing connects to the carrying strap at a mid-portion of the carrying strap.

Other implementations are also described and recited herein. Further, while multiple implementations are disclosed, still other implementations of the presently disclosed technology will become apparent to those skilled in the art from the following detailed description, which shows and describes illustrative implementations of the presently disclosed technology. As will be realized, the presently disclosed technology is capable of modifications in various aspects, all without departing from the spirit and scope of the presently disclosed technology. Accordingly, the drawings and detailed description are to be regarded as illustrative in nature and not limiting.

DETAILED DESCRIPTION

Figure 1:
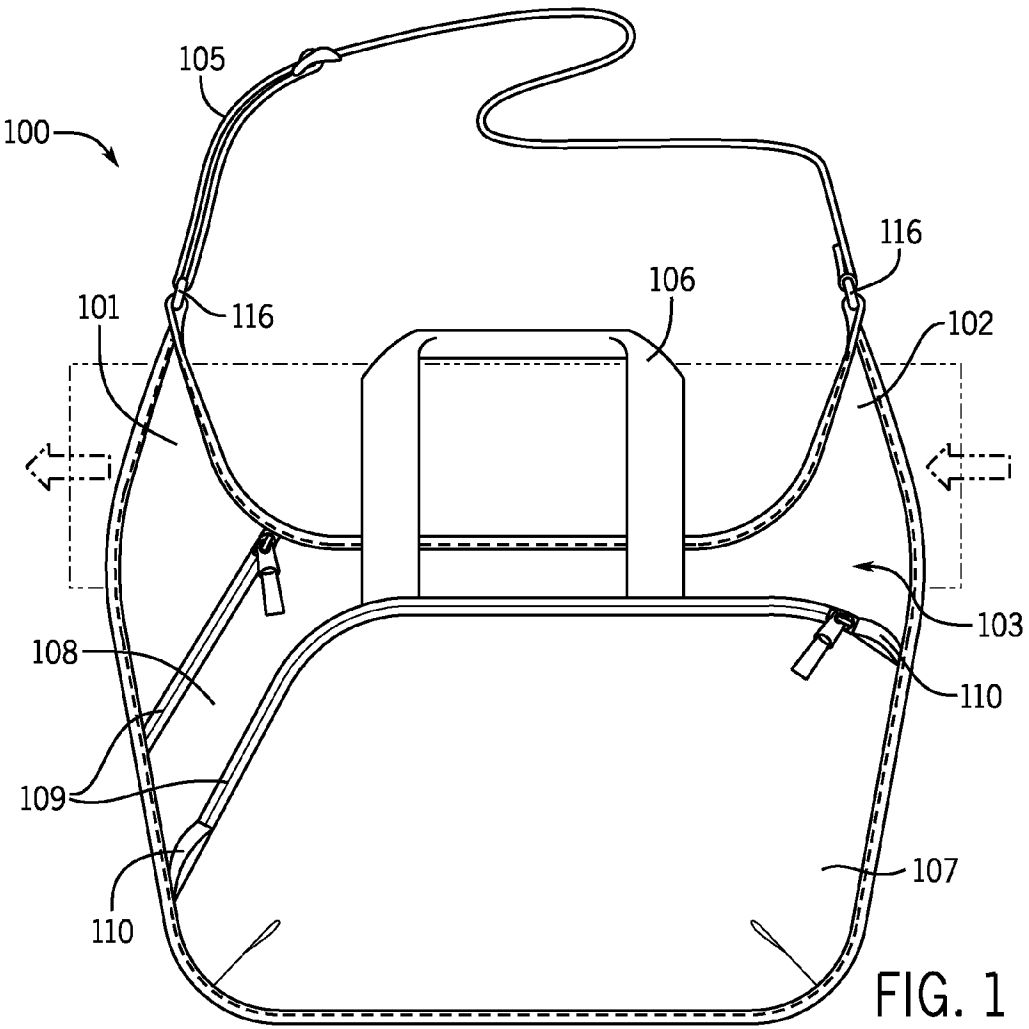
FIG. 1 is a front view of an example dual function bag carrying a yoga mat (shown in dashed lines)

Aspects of the present disclosure involve a bag adapted for use in both a work environment and a recreational environment. In one particular aspect, a soft sided bag constructed from materials with antimicrobial properties is provided. The bag is adapted to be worn over a shoulder and for securely carrying and ventilating work and/or recreational materials in an interior of the bag and on an exterior of the bag. The bag provides accommodating features for both work materials and recreational materials.

In another aspect, the bag includes a shoulder harness that comprises at least one pair of Y-shaped attachments that integrate with the bag and connect to an adjustable carrying strap. The Y-shaped attachments are coupled to each other at a connection point and are configured to slideably receive one or more articles, such as a rolled-up yoga matt. When the bag is lifted, the Y-shaped attachments cinch or squeeze the yoga mat, thus securing and restricting the mat from unwanted movement during transport.

In still another aspect, a front side and a back side of the bag are connected by a ventilation strip and a base strip, which forms a housing. An enclosure is created by the housing that forms the interior of the bag. The ventilation and base strips may be each constructed from a continuous piece of material or a plurality of pieces. The ventilation strip may form a top and first and second sides of the bag. The ventilation strip may be constructed from a continuous strip of mesh-type foam material surrounded by netting on both sides. The mesh-type foam material provides structure and ventilation for both the materials on the inside of the bag (e.g., exercise clothing) and materials on the outside of the bag (e.g., yoga mat). The first side of the bag may include an elastic mesh bottle pouch. The base strip may form a bottom of the bag that continues in a line and shape of the top and sides of the bag.

In yet another aspect, the front side of the bag includes a large pocket and a small pocket. The large and small pockets may be secured with a fastening mechanism, such as a zipper, hook and loop fasteners, etc. The large pocket includes a padded backing with a pocket for securing and protecting a computing device (e.g., a tablet or slate, personal computer, etc.) and a key strap holder. The small pocket includes a soft mesh interior for convenient and safe storage of relatively smaller computing devices (e.g., smart phones, music players, personal digital assistants, etc.) or other valuable items. The back side of the bag may include a similar design appearance to the front in that it includes a large pocket and a small pocket. The large pocket of the back side may include a padded backing to secure and protect additional items. The interior material of the small pocket is the same as the interior material of the large pockets of both the back and front sides of the bag. The front and back sides may also include a pair of carrying handles.

Finally, in another aspect, the interior portion of the bag includes a divider panel that bisects the interior space of the bag enclosure and is generally parallel to the first and second sides of the hag that are formed by the ventilation strip. The divider panel separates the interior portion of the bag into roughly a first volumetric portion (e.g., two-thirds) and a second volumetric portion (e.g., one-third), wherein the second volumetric portion is at least partially defined by the divider panel and the first side of the bag. The first and second volumetric portions form vented compartments and may include one or more washable inserts. The divider panel may be used to separate one or more articles from the remainder of the interior of the bag and to prevent certain articles from comingling with others. For example, the divider panel may be used to separate and isolate wet or dirty articles or to separate and isolate shoes. Additionally, the divider panel holds such articles near the ventilation strip to ensure that the articles are ventilated. The first volumetric portion may include additional large and/or small pouches with fastening mechanisms. The pouches may include, for example, a see-through mesh liner, a soft mesh interior, a solid textile material or fabric, etc.

Figure 2:
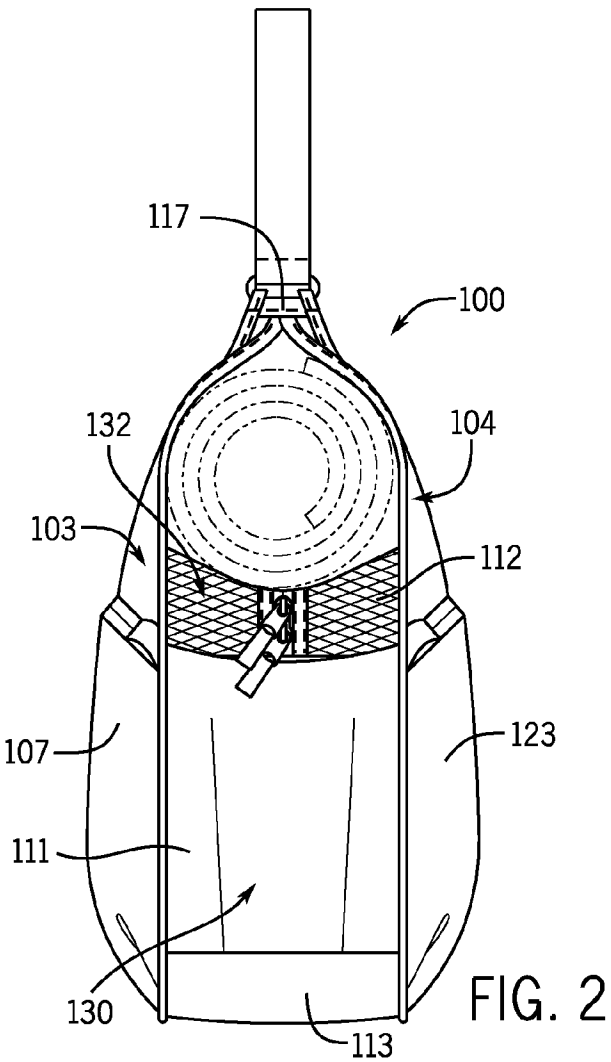
FIG. 2 is side view of a first side of the dual function bag.

Turning to FIGS. 1 and 2, a front view and a side view of an example bag 100 carrying a yoga mat (shown in dashed lines) are illustrated, respectively. While a yoga matt is shown in FIGS. 1 and 2, it will be appreciated by those skilled in the art that one or more articles of various types may be carried in place of the yoga mat. In one implementation, the bag includes two sets of Y-shaped attachments 101 and 102 that integrate with the body of the front 103 and back 104 of the bag. The Y-shaped attachments 101 and 102 each connect to an end of an adjustable carrying strap 105.

In one implementation, the front 103 of the bag includes one half of a set of carrying handles 106. The front 103 of the bag may also include one or more pockets (e.g., a large pocket 107 and a small pocket 108) securable with fastening mechanisms, such as reversed zippers 109. The large pocket 107 may include a tab 110 at each end of the zipper 109, which are adapted to attach additional straps. The tabs 110 can also assist a user in zipping or unzipping the pockets, by providing a piece of material to grab onto and oppose the force of zipping or unzipping.

As can be understood from FIG. 2, a first side 130 of the bag 100 is opposite a second side 131 and adjacent to a top 132 and to a bottom 113 of the bag 100. In this particular implementation, a ventilation strip is formed from the top 132 and the first and second sides 130, 131 of the bag 100. The ventilation strip is constructed from a continuous strip of netted, mesh-type foam material 112. The netted, mesh-type foam material 112 provides structure and ventilation for both the articles on the inside of the bag (e.g., exercise clothing) and articles on the outside of the bag (e.g., the yoga mat). The bottom 113 of the bag may be a base strip formed from a continuous strip of fabric that continues in the line and shape of the top 132 and sides of the bag. In one implementation, the bag 100 includes an elastic mesh bottle pouch 111 on the first side 130.

The Y-shaped attachments 101 and 102 are coupled at a connection point 117, thereby forming a receiving space that is adapted to slideably receive one or more articles, such as the rolled-up yoga matt. When tension is applied to the carrying strap 105, for example, when the bag is lifted by the carrying strap 105, the Y-shaped attachments 101 and 102 cinch the yoga mat against the Y-shaped attachments 101 and 102 and the top 132 of the bag. Cinching the yoga mat secures and restricts the mat from unwanted movement while transporting the bag. To aid in the cinching, the netted, mesh-type foam material 112 on the top 132 of the bag and the Y-shaped attachments 101 and 102 generally contour to the shape of the articles as the bag is lifted. The ability to receive a rolled up yoga mat on the outside of the bag, as well as the function of cinching the yoga mat provides an easy and convenient way to transport the yoga mat from place to place.

Further, the ventilation strip formed from the netted, mesh-type foam material 112 on the top 132 and sides 130, 131 of the bag provides ventilation for articles inside the bag (e.g., damp gym clothes, shoes, etc.) as well as for articles on the outside of the bag (e.g., the yoga mat). As such, the ventilation strip mitigates dampness and/or foul odors on articles in the interior of the bag 100, by allowing the articles to commingle with air from outside of the bag 100. Whereas most gym bags do not provide a way to circulate fresh air into the bag, the ventilation strip admits fresh air into the bag, replaces the noxious air in the bag 100 with fresh air, and ultimately freshens the articles in the bag 100.

In addition to providing ventilation for articles on the outside the bag (e.g., yoga mat), the ventilation strip does not trap moisture between articles stored in the receiving space (e.g., the yoga mat) and the top 132 of the bag 100. By having a netted, mesh-type material 112 on the ventilation strip, the bottom surface of the article that is placed on the top 132 (i.e., the part of the article in contact with the top 132 of the bag 100) can still breathe through the mesh-type material 112. As such, despite being cinched in the receiving space, the bottom surface of a damp article (e.g., yoga mat) that is placed on top 132 of the bag is vented.

Figure 3:
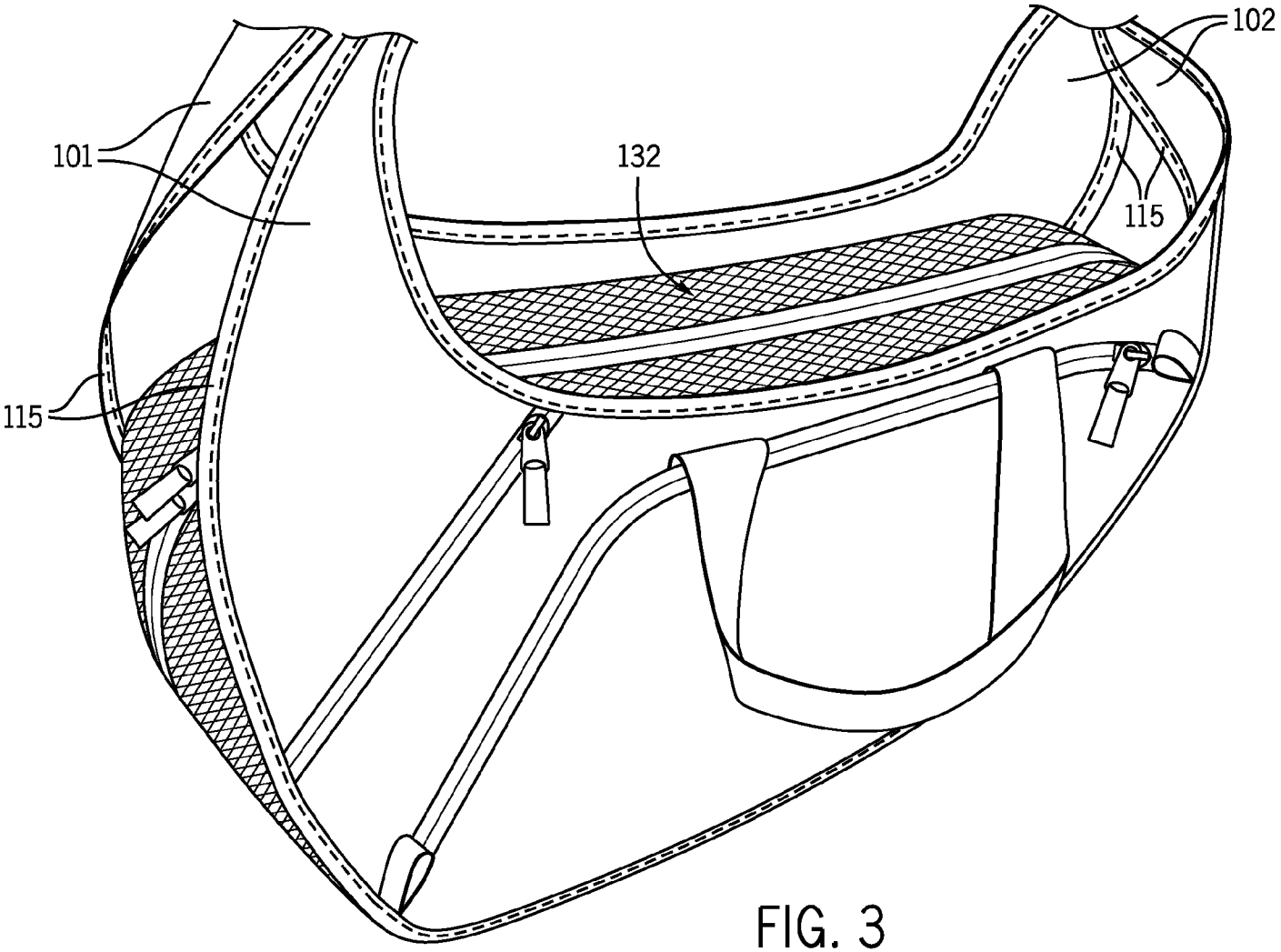
FIG. 3 is a perspective view of the front of the dual function bag, wherein a top portion of the Y-shaped attachments are not shown.

FIG. 3 depicts a front view of the bag 100. In some implementations, a star-patterned stitching (not shown) is used on the large pocket 107 of the front of the bag 100. As can be understood from FIG. 4, which is a perspective view of the front of the bag 100 with opened pockets, the Y-shaped attachments 101 and 102 each form a receiving space that is adapted to cinch an inserted yoga mat. Specifically, in one implementation, outer ends 115 of the Y-shaped attachments 101 and 102 pull inward (i.e. towards the general center of the top 132 of the bag 100), when tension is applied to the carrying strap 105 (e.g., by lifting the bag 100 by the carrying strap 105. Since the outer ends 115 of the Y-shaped attachments 101 and 102 connect to a connection point 117 of a shoulder strap loop 116 as well as flush with the front 103 and back 104 of the bag 100, as tension is applied to the carrying strap 105, the outer ends 116 roll inward and exert pressure on the received article(s) (e.g., yoga mat).

Figure 4:
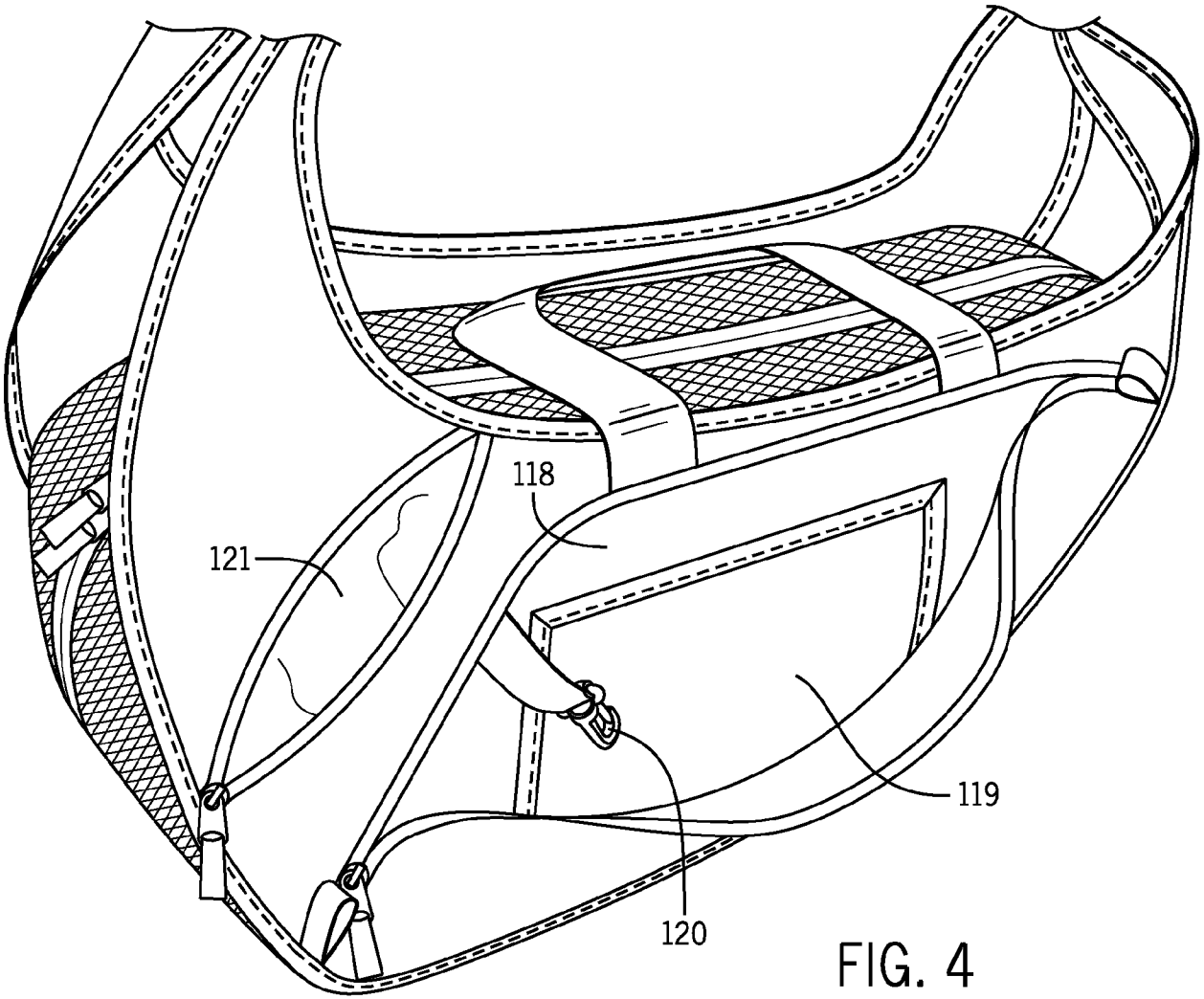
FIG. 4 is a perspective view of the front of the dual function bag with a large pocket and a small pocket in an opened position, wherein the top portion of the Y-shaped attachments are not shown.
Figure 6:
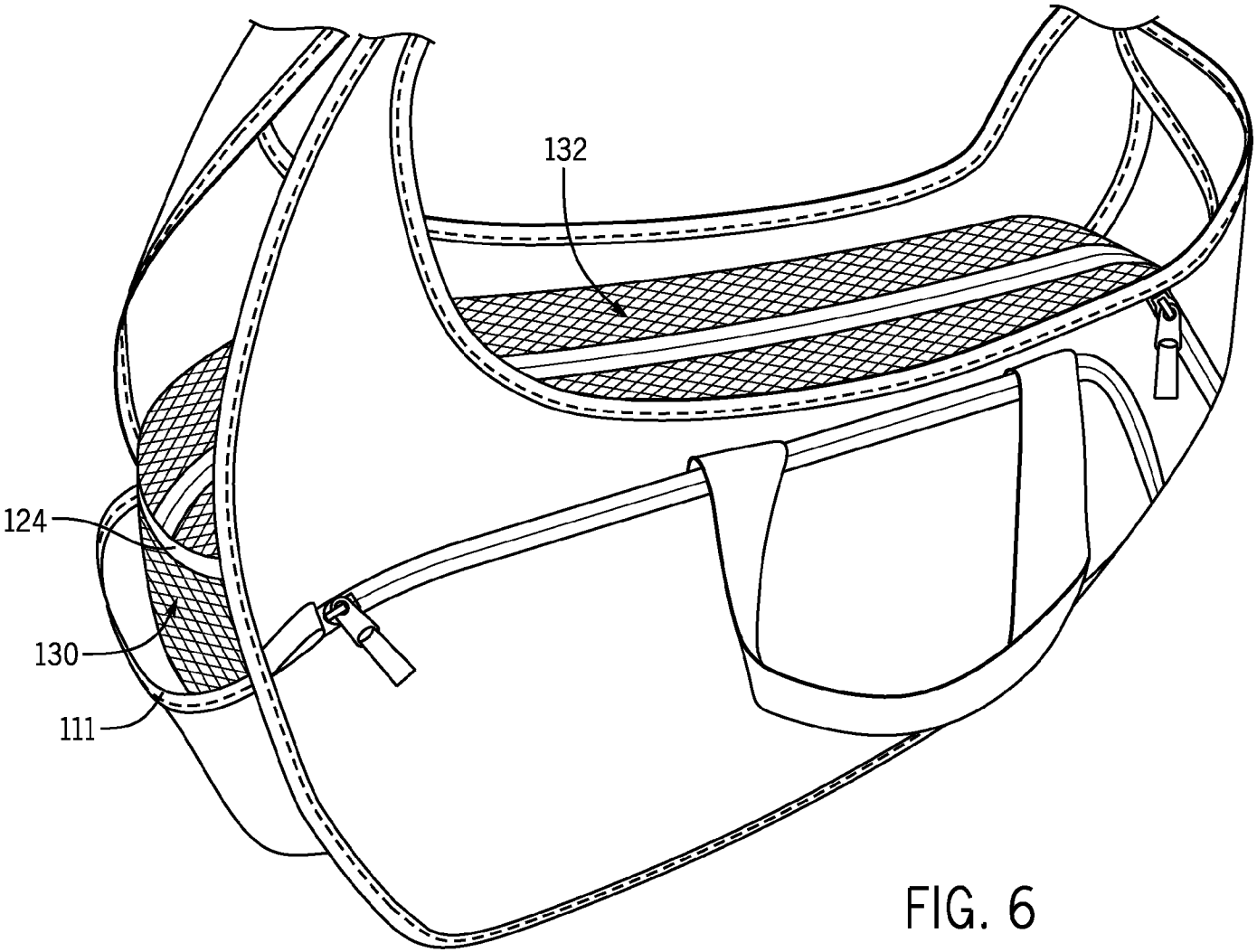
FIG. 6 is a perspective view of the back of the bag, wherein the top portion of the Y-shaped attachments are not shown.

Referring still to FIG. 4, an interior portion of the large pocket 107 on the front 103 of the bag 100 is shown. In one implementation, the large pocket 107 includes a padded backing 118 with a tablet pocket 119 for storing a tablet, slate, or other computing device. The large pocket 107 may also include a key strap holder 120, whereby a key ring can be clipped onto the key strap holder 120. FIG. 6 illustrates a perspective view of the front 103 of the bag with both the large 107 and small 108 pockets open. The small pocket 108 may include a soft mesh interior 121 for convenient and safe storage of relatively smaller computing devices or other valuables (e.g., smart phones, music players, PDS's, etc.).

Figure 5:
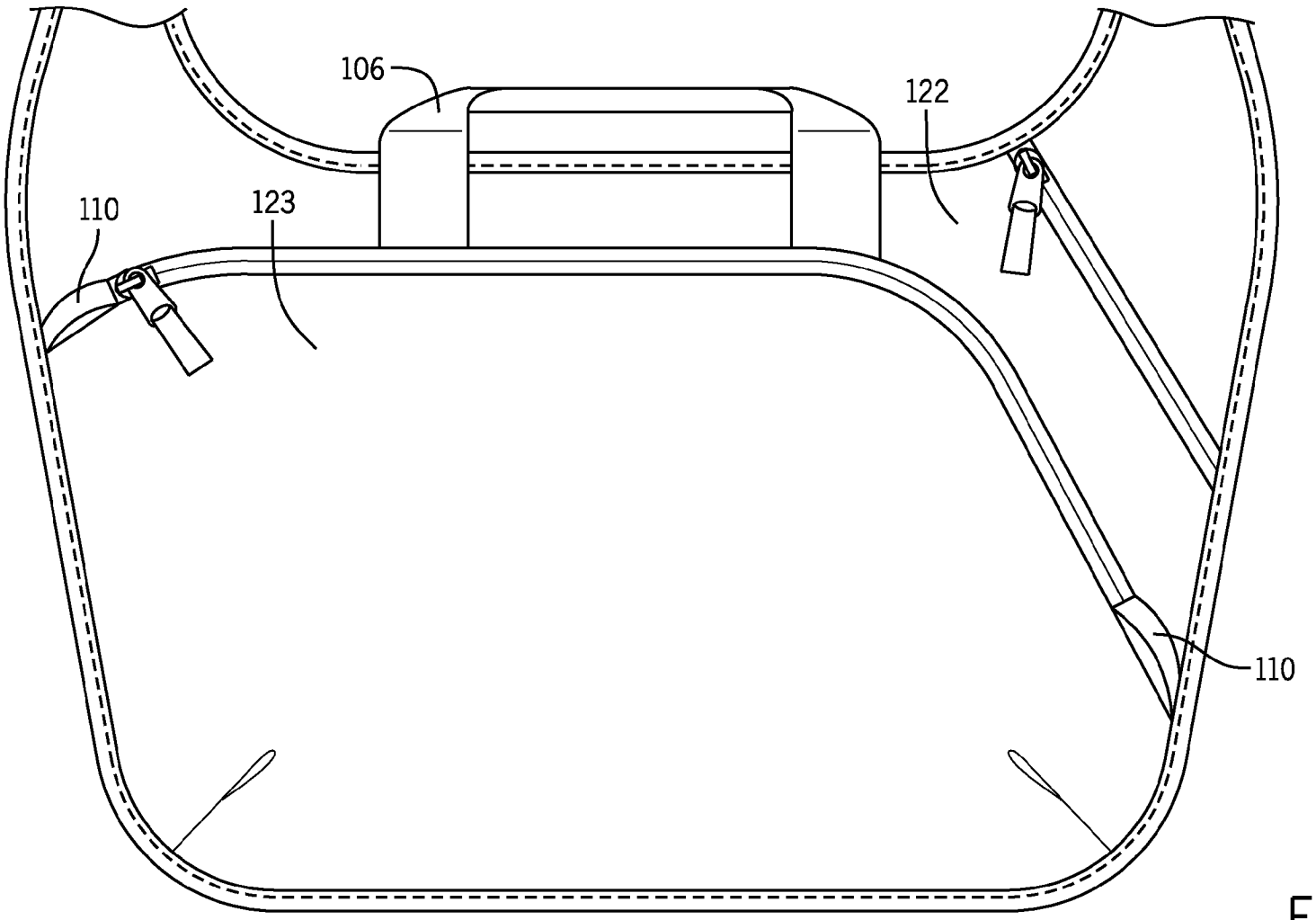
FIG. 5 is a back view of the bag, wherein the top portion of the Y-shaped attachments are not shown.

FIG. 5 is a back view of the bag. In one implementation, the features on the back 104 of the bag 100 are substantially similar to the features on the front 103 of the bag 100. For example, a small pocket 122 may be positioned near an upper section of the back 104 of the bag 100 and a large pocket 123 may open with a fastening mechanism, such as a zipper, near a bottom section of the back 104 of the bag 100. However, other pockets and features may be included on one or both of the front 103 and the back 104 of the bag 100.

FIG. 6 shows a perspective view of the back 104 of the bag 100. In this view, the elastic mesh bottle pouch 111 on the first side 130 is visible. Also, this figure depicts a bottom stop 124 of the zipper on the top 132 of the bag 100, which is near the opening of the elastic mesh bottle pouch 111. The netted, mesh-type material 112 continues on the first side 130 of the bag (i.e., as a backing for the elastic mesh bottle pouch 111), despite the bottom stop 124.

Figure 7:
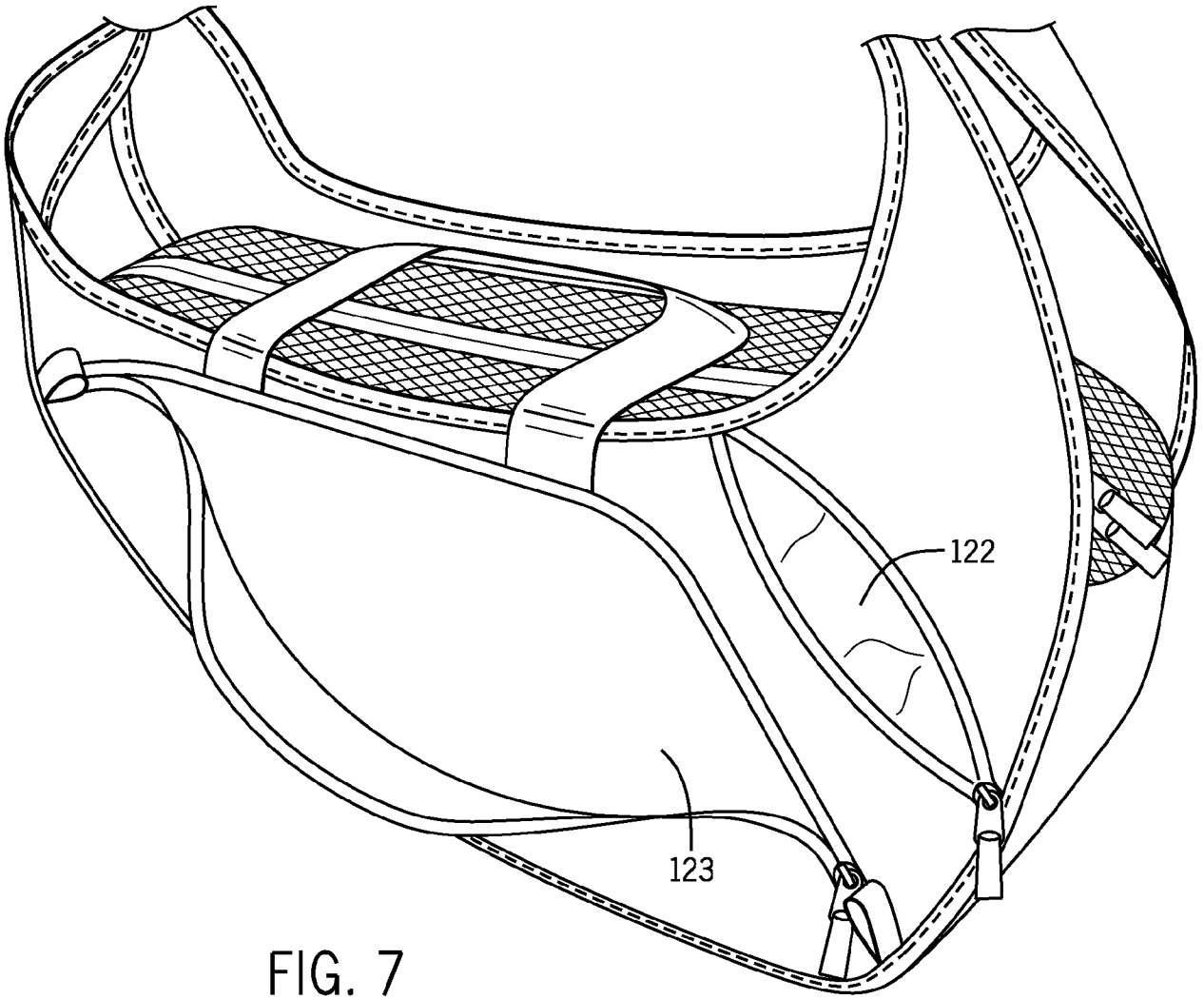
FIG. 7 is a perspective view of the back of the dual function bag with a large pocket and a small pocket in an opened position, wherein the top portion of the Y-shaped attachments are not shown.

FIGS. 6-7 depict the large pocket 123 on the back 104 of the bag 100 as well as the small pocket 122 on the back 104 of the bag 100. In particular, FIG. 7 is a perspective view of the back 104 of the bag 100 showing the large pocket 123 open, as well as the small pocket 122 open.

Figure 8:
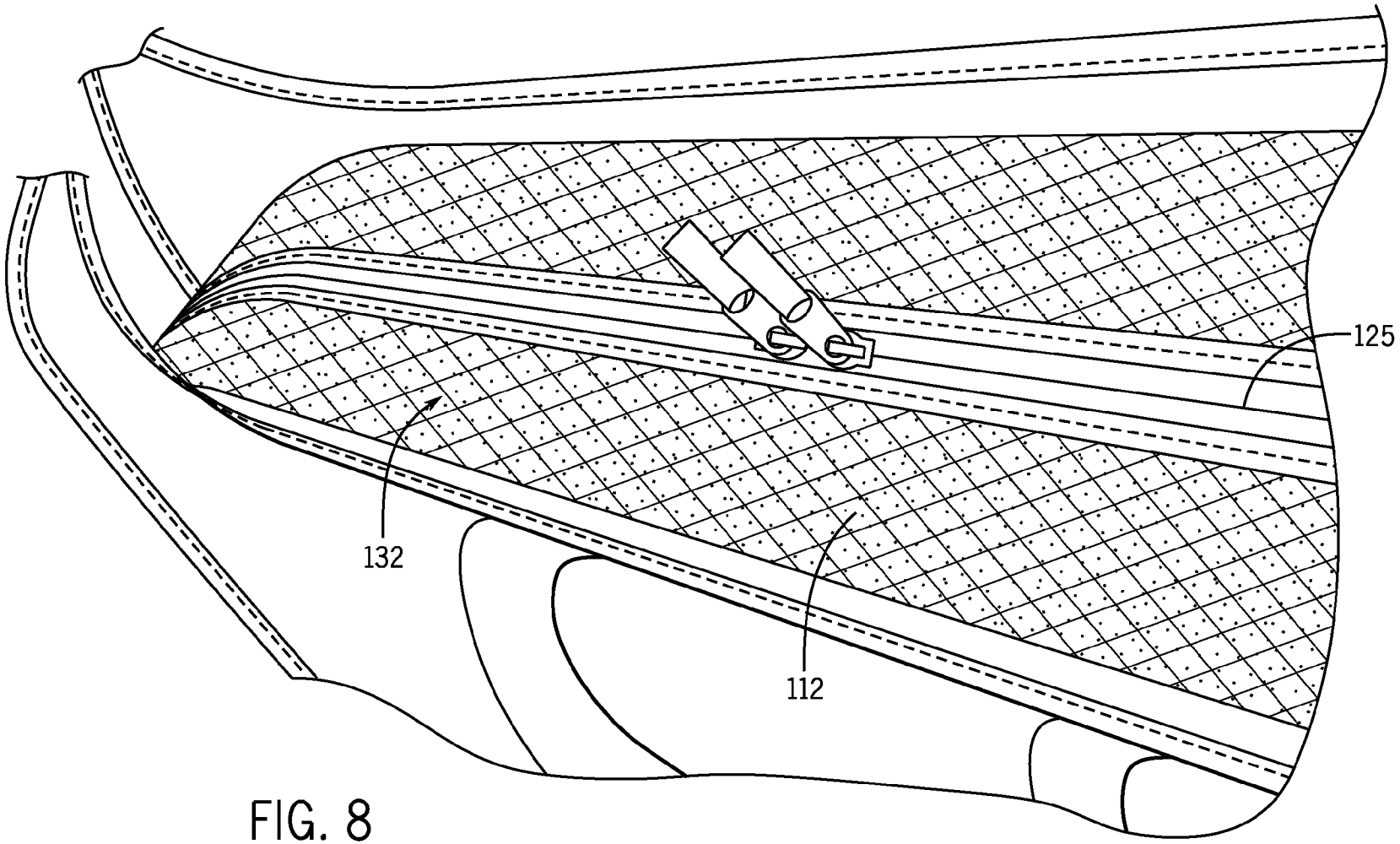
FIG. 8 is a perspective view of a portion of the top of the dual function bag depicting a reversed zipper and a ventilation strip.
Figure 9:
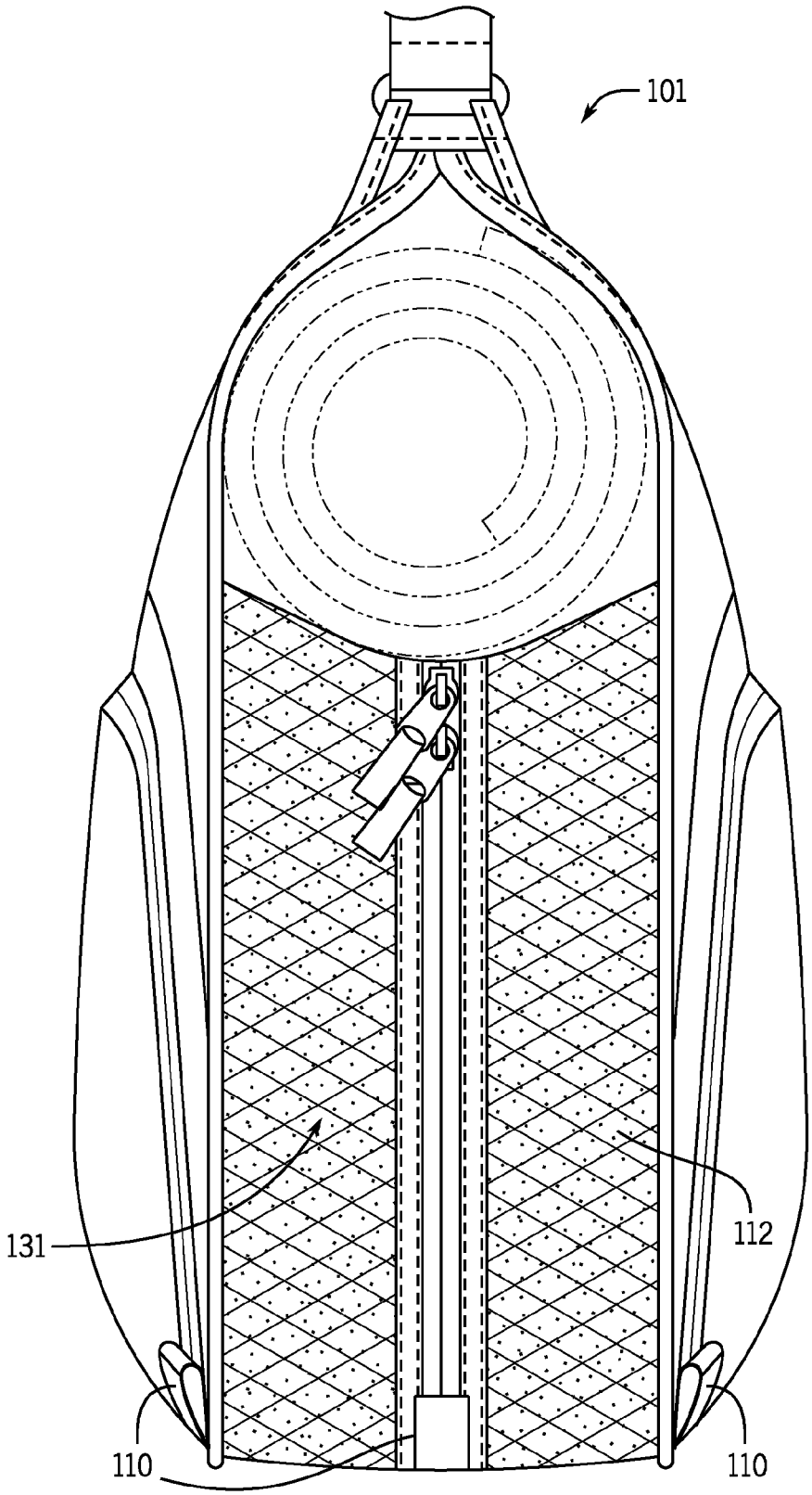
FIG. 9 is a side view of a second side of the dual function bag carrying a yoga mat (shown in dashed lines)

FIGS. 8-9 illustrate the netted, mesh type material 112 on the top 132 and sides 130 and 131 of the hag, as well as the reversed zipper 125. In one implementation, the netted, mesh-type material 112 includes an inner meshed foam-type material that provides padding for articles in the interior of the bag 100. The inner meshed foam-type material may include oblong, circular cutouts or apertures that allow air from the inside of the bag 100 to circulate with air from the outside of the bag 100 and vice versa. The material 112 may also include a netting on both sides of the foam-type material. This netting may be made from materials, including, without limitation, a threading that provides abrasion and tear resistance.

FIG. 9 illustrates the second side 131 of the bag 100 showing the ventilation strip formed a continuous strip of material extending across the top 132 and the sides 130 and 131 of the bag 100 (i.e., the top 132 and the sides 130 and 131 are made from a continuous strip of the netted, mesh-type material 112). As shown, the ventilation strip includes a smooth transition from the top 132 of the bag to the second side 131 of the bag, and likewise from the top 132 to the first side 130. The netted, mesh-type material 112 on the sides 130 and 131 of the bag provide a flow path for air into and out of the bag, even when there are articles positioned in the receiving space on the top 132 of the bag 100. FIG. 9 illustrates the tabs 110 at the base of the large pocket 107 on the front 103 and the large pocket 123 on the back 104 of the bag 100, as well as the tab 110 at the base of the second side 131.

Figure 10:
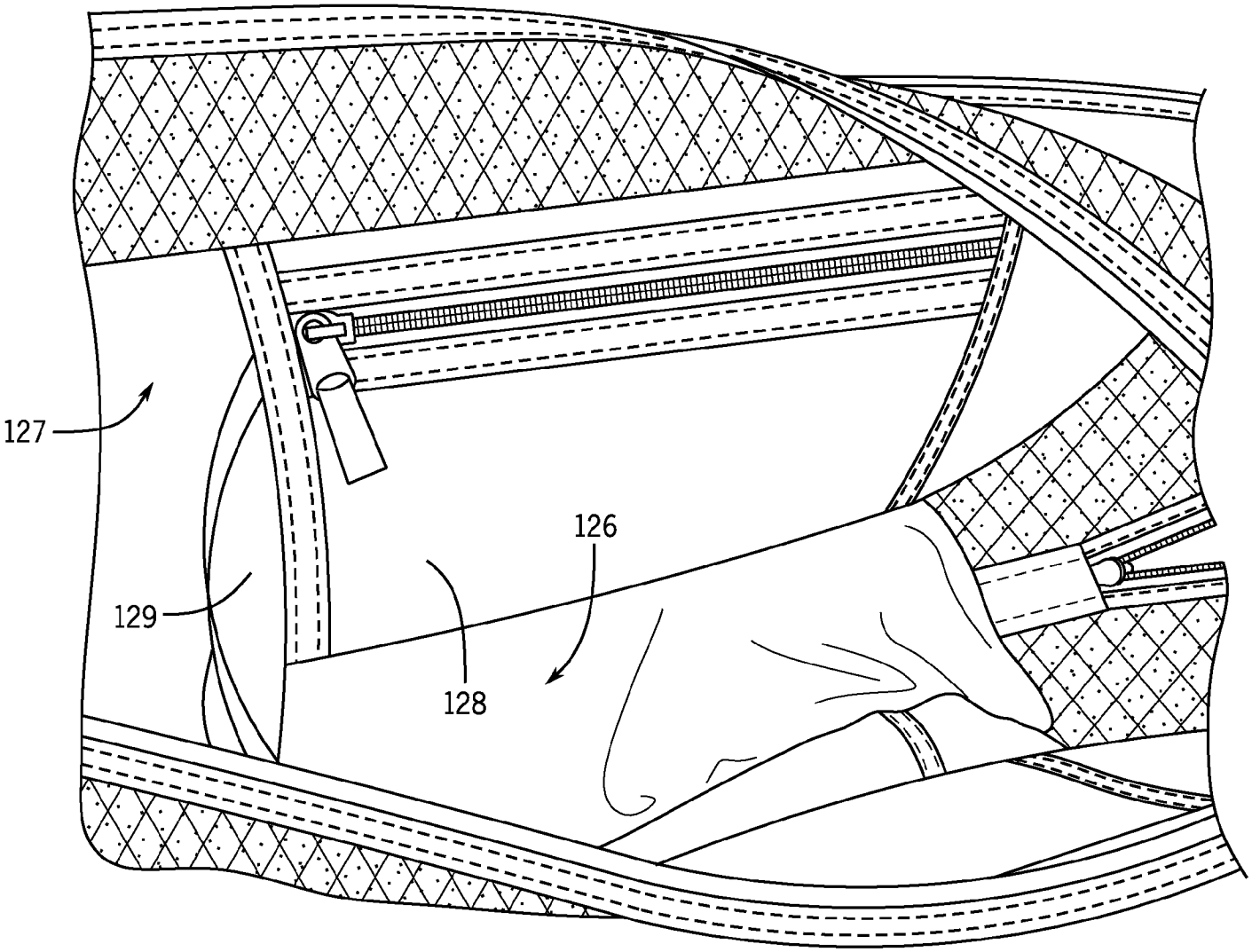
FIG. 10 is an interior view of the bag.

FIG. 10 illustrates an interior portion 126 of the bag 100, or more particularly, an interior front 127 of the interior portion 126 of the bag 100. In one implementation, the interior front 127 includes a large pouch 128 made from a solid, non-mesh, fabric. The interior portion 126 of the bag 100 includes a divider panel 129 that bisects the interior portion 126 of the bag 100 and is generally parallel to the sides 130 and 131 of the bag 100. The divider panel 129 divides the interior portion 126 of the bag into a first volumetric portion (e.g., roughly two-thirds) and a second volumetric portion (e.g., roughly one-third), wherein the second volumetric portion is at least partially defined by the divider panel 129 and the interior front 127. The divider panel 129 separates a portion of the articles stored in the interior portion 126 so that certain articles will not intermingle with others. For example, when at the gym, dress shoes can be stored one side of the divider panel 129, and formal clothes can be stored on the other side of the divider panel 129. In this way, the formal clothes are separated from any dirt that may collect on the bottom of the dress shoes. An advantage to having a divider panel 129 instead of separately sealed compartments in the bag is that articles on either side of the divider panel ventilate with the ambient air on the outside of the bag 100 via the ventilation strip.

Figure 11:
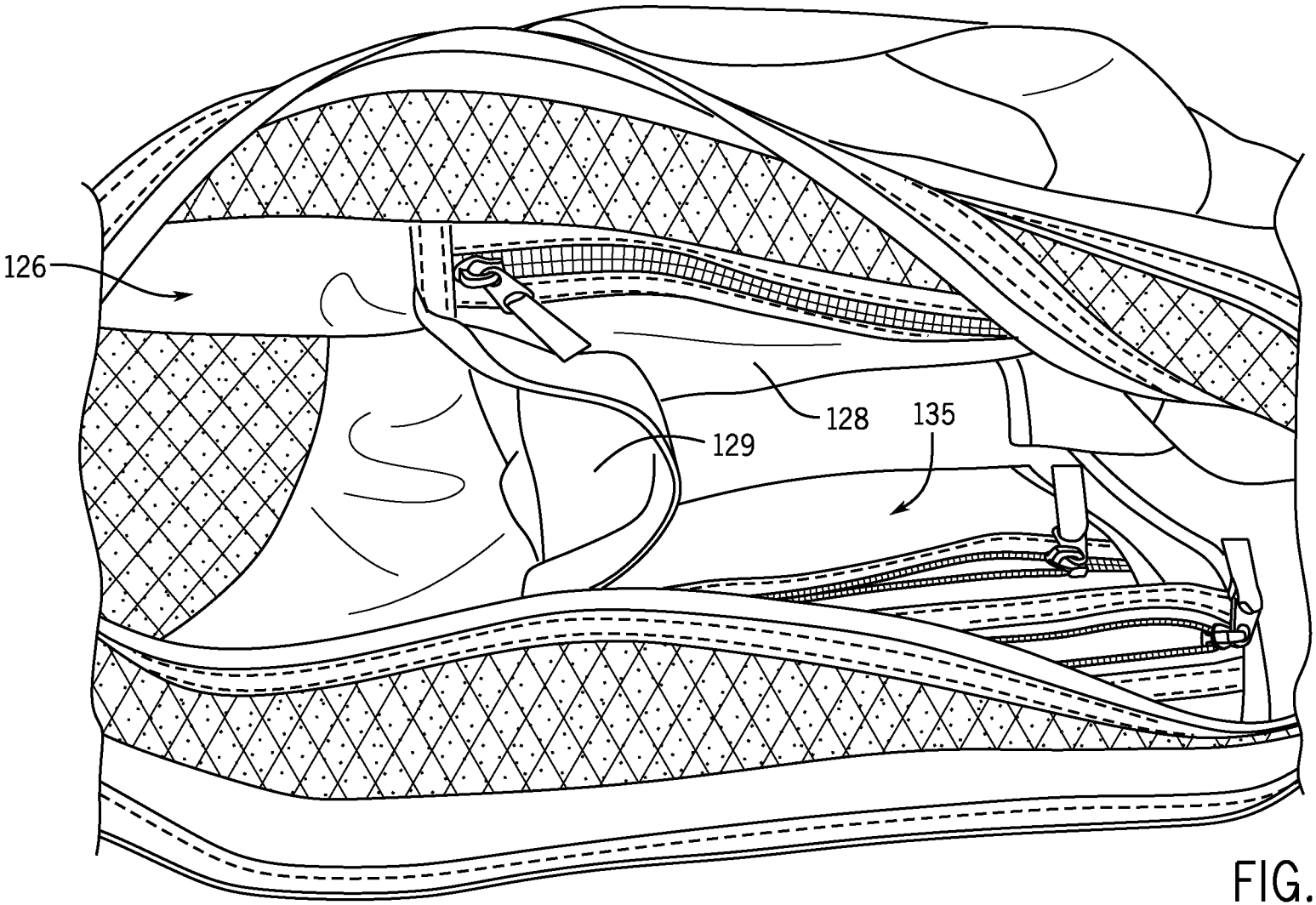
FIG. 11 is an interior view of a divider panel.
Figure 12:
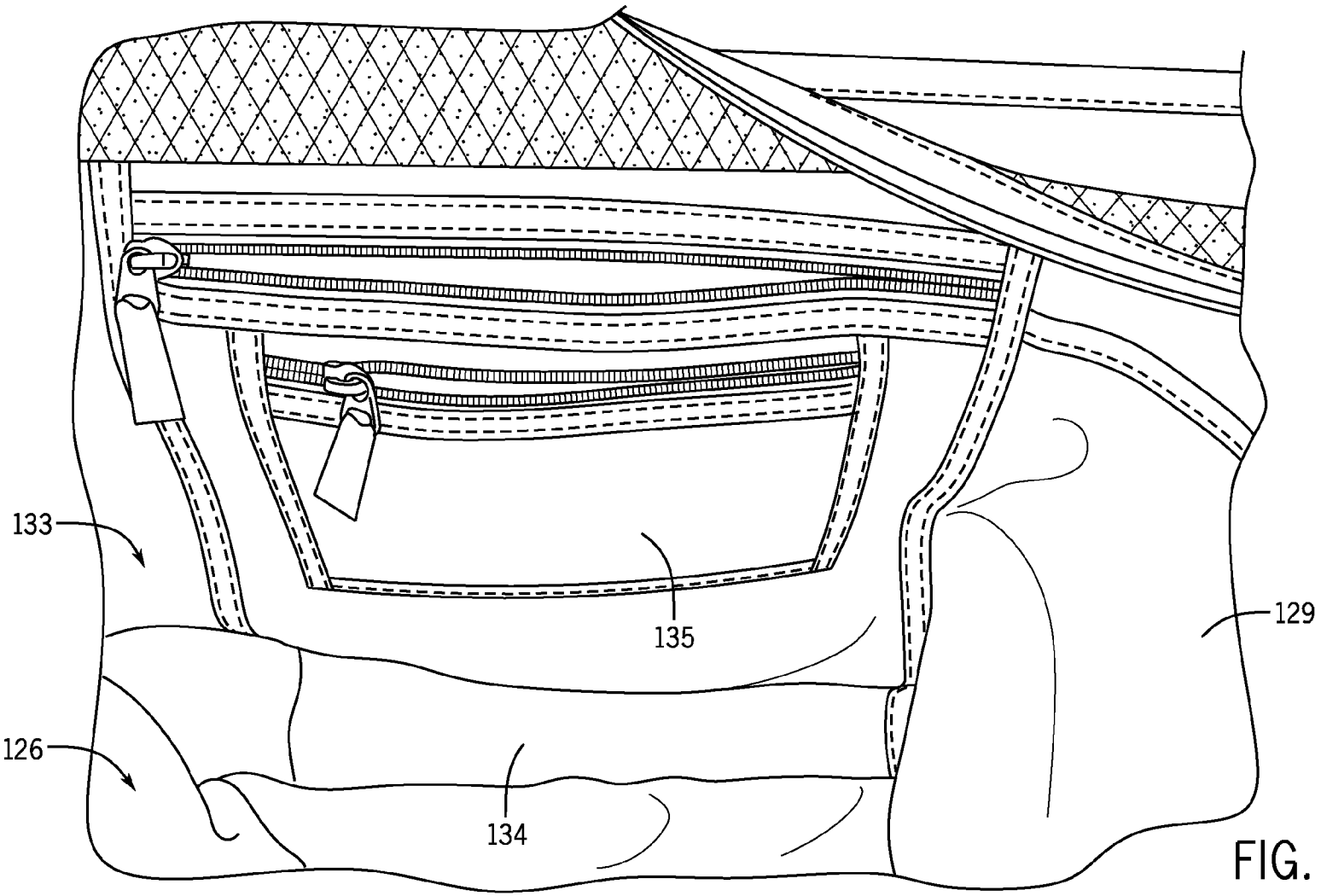
FIG. 12 is another interior view of the bag.

FIG. 11 is a top view of the interior portion 126 of the bag 100, and FIG. 12 illustrates the interior portion 126 of the bag 100, or more particularly, an interior back 133 of the interior portion 126. In one implementation, the interior back 133 includes a large pouch 134 and a small pouch 135. The large pouch 134 includes a see-through mesh liner. The small pouch 135 is nested on top of the larger pouch 134, and includes a soft mesh interior.

In some implementations, one or more portions of the bag 100 are made from materials having antimicrobial product protection properties. Since the bag 100 is suitable for use in various environments, including those where microorganisms, such as bacterial and fungi, thrive (e.g., gyms, yoga studios, locker rooms), such materials help inhibit the growth of such microorganisms in or on the bag 100.

The above specification, examples, and data provide a complete description of the structure and use of exemplary implementations of the invention. Since many implementations of the invention can be made without departing from the spirit and scope of the invention, the invention resides in the claims hereinafter appended. Furthermore, structural features of the different implementations may be combined in yet other implementations without departing from the recited claims.

What is claimed is:

1. A bag comprising:

a housing formed from a front side and a back side connected by a ventilation strip and a base strip, the housing creating an enclosure;

a first attachment extending from and integral with the front side;

a second attachment extending from and integral with the back side, the first and second attachments being coupled at a connection point to form a receiving space adjacent to the ventilation strip outside the enclosure, the receiving space being adapted to receive one or more articles; and a carrying strap coupled to the connection point, wherein the connection point is adapted to cinch the one or more articles in the receiving space when tension is applied to the carrying strap.

2. The bag of claim 1, wherein the one or more articles includes a yoga mat.

3. The bag of claim 1, further comprising:

a third attachment extending from and integral with the front side, the first attachment being disposed near a first end of the front side and the third attachment being disposed near a second end of the front side; and a fourth attachment extending from and integral with the back side, the second attachment being disposed near a first end of the back side generally opposite the first attachment and the fourth attachment being disposed near a second end of the back side generally opposite the third attachment, the third and fourth attachments being coupled at a second connection point to form a second receiving space adjacent to the ventilation strip outside the enclosure and generally coplanar with the first receiving space.

4. The bag of claim 1, wherein the bag is constructed from a material having antimicrobial product protection properties.

5. The bag of claim 1, wherein the tension is applied to the carrying strap once the bag is lifted by the carrying strap.

6. The bag of claim 1, wherein the ventilation strip is a breathable, mesh fabric adapted to allow the one or more articles to ventilate through the ventilation strip when the one or more articles are cinched in the receiving space.

7. The bag of claim 6, wherein the breathable, mesh fabric is a flexible material adapted to mold to a shape of the one or more articles in the receiving space.

8. A bag comprising:

a housing comprising a first side, a second side opposite the first end, and a body extending between the first side and the second side to form an enclosure;

a carrying strap; and an attachment assembly comprising a first Y-shaped attachment and a second Y-shaped attachment, the first Y-shaped attachment comprising a first pair of arms that extend from upper corners of the first side to meet at a first point outside of the enclosure to form a first receiving space between the first Y-shaped attachment and the housing, the second Y-shaped attachment comprising a second pair of arms that extend from upper corners of the second side to meet at a second point outside of the enclosure to form a second receiving space between the second Y-shaped attachment and the housing, the first point and the second point being coupled together with the carrying strap, the first and the Y-shaped attachments adapted to cinch one or more articles in the first and the second receiving spaces when tension is applied to the carrying strap.

9. The bag of claim 8, wherein the body includes a ventilation strip on a top portion of the housing.

10. A bag comprising:

a housing forming an enclosure therein, the housing comprising a ventilation strip on a top portion of the housing;

a carrying strap; and at least one attachment mechanism that couples the housing to the carrying strap, the at least one attachment mechanism comprising:

at least two members that extend from an attachment point to opposing portions of the housing to form a receiving space between the at least two members and the ventilation strip, the receiving space adapted to cinch one or more articles within the receiving space when the carrying strap is tensioned.

11. The bag of claim 10, wherein the opposing portions of the housing are a first and a second panel, the ventilation strip positioned between the first and the second panel.

12. The bag of claim 11, wherein the at least one attachment mechanism comprises a first attachment mechanism, and the at least two members comprise a first arm and a second arm, the first arm comprising a first portion of the first panel that extends to the carrying strap, the second arm comprising a second portion of the second panel that extends to the carrying strap.

13. The bag of claim 12, wherein the at least one attachment mechanism further comprises a second attachment mechanism on an opposite side of the carrying strap from the first attachment mechanism, the at least two members further comprising a third arm and a fourth arm, the third arm comprising a third portion of the first panel that extends to the carrying strap, the fourth arm comprising a fourth portion of the second panel that extends to the carrying strap.

14. The bag of claim 10, wherein the ventilation strip is a flexible material configured to mold to a shape of the at least one article in the receiving space.

15. The bag of claim 12, wherein the first portion of the first panel that extends to the carrying strap connects to the housing at a top portion and a bottom portion of the housing.

16. The bag of claim 15, wherein an upper portion of the first portion of the first panel that connects to the housing at the top portion of the housing connects to the carrying strap at an outer portion of the carrying strap, and a lower portion of the first portion of the first panel that connects to the housing at a bottom portion of the housing connects to the carrying strap at a mid-portion of the carrying strap.

17. The bag of claim 15, wherein the second portion of the second panel that extends to the carrying strap connects to the housing at the top portion and the bottom portion of the housing.

18. The bag of claim 17, wherein an upper portion of the second portion of the second panel that connects to the housing at the top portion of the housing connects to the carrying strap at an outer portion of the strap, and a lower portion of the second portion of the second panel that connects to the housing at a bottom portion of the housing connects to the carrying strap at a mid-portion of the carrying strap.

19. The bag of claim 12, wherein the first portion of the first panel that extends to the carrying strap extends from an outer end of the first panel, and the second portion of the second panel that extends to the carrying strap extends from an outer end of the second panel.

20. The bag of claim 16, wherein the upper portion of the first panel that connects to the housing at a top portion of the housing spans a shorter distance to the carrying strap than the lower portion of the first panel that connects to the housing at a bottom portion of the housing.

* * * * *